US008590518B2

(12) United States Patent
Lerchenmueller

(10) Patent No.: US 8,590,518 B2
(45) Date of Patent: Nov. 26, 2013

(54) IGNITION COIL

(75) Inventor: Klaus Lerchenmueller, Untermaiselstein (DE)

(73) Assignee: Robert Bosch GmbH, Stuttgart (DE)

( * ) Notice: Subject to any disclaimer, the term of this patent is extended or adjusted under 35 U.S.C. 154(b) by 770 days.

(21) Appl. No.: 12/302,982

(22) PCT Filed: Apr. 23, 2007

(86) PCT No.: PCT/EP2007/053927

§ 371 (c)(1), (2), (4) Date: Aug. 18, 2010

(87) PCT Pub. No.: WO2007/137915

PCT Pub. Date: Dec. 6, 2007

(65) Prior Publication Data

US 2010/0307467 A1 Dec. 9, 2010

(30) Foreign Application Priority Data

May 30, 2006 (DE) ..... 10 2006 025 073

(51) Int. Cl.
*H01F 38/12* (2006.01)

(52) U.S. Cl.
USPC ..... 123/634; 123/630; 73/114.62

(58) Field of Classification Search
USPC ..... 123/630, 634; 73/114.62
See application file for complete search history.

(56) References Cited

U.S. PATENT DOCUMENTS

| | | | | |
|---|---|---|---|---|
| 1,362,138 | A | 12/1920 | Pratt | |
| 3,959,725 | A | 5/1976 | Capek | |
| 5,391,100 | A | 2/1995 | Maruyama et al. | |
| 5,399,942 | A * | 3/1995 | Frus | 315/209 R |
| 5,406,921 | A * | 4/1995 | Noble et al. | 123/479 |
| 5,411,006 | A * | 5/1995 | Noble et al. | 123/634 |
| 6,359,439 | B1 * | 3/2002 | Crecelius et al. | 324/391 |
| 6,940,283 | B2 * | 9/2005 | McQueeney | 324/380 |
| 6,951,201 | B2 * | 10/2005 | Zhu et al. | 123/406.27 |
| 6,969,995 | B2 | 11/2005 | Virchow | |
| 7,063,079 | B2 * | 6/2006 | Huberts et al. | 123/630 |
| 2003/0168049 | A1 * | 9/2003 | Zarkhin et al. | 123/609 |
| 2004/0084034 | A1 * | 5/2004 | Huberts et al. | 123/630 |
| 2004/0084035 | A1 * | 5/2004 | Newton | 123/630 |
| 2004/0084036 | A1 * | 5/2004 | Porter et al. | 123/634 |
| 2005/0284455 | A1 | 12/2005 | Kassner | |
| 2007/0188176 | A1 * | 8/2007 | Dittmann et al. | 324/378 |

FOREIGN PATENT DOCUMENTS

| | | |
|---|---|---|
| DE | 2 245 194 | 3/1973 |
| DE | 23 39 734 | 3/1975 |
| DE | 89 10 945 | 12/1989 |
| DE | 40 40 236 | 6/1992 |
| DE | 92 12 122 | 5/1993 |
| DE | 92 16 908.2 | 5/1994 |
| DE | 44 43 304 | 6/1996 |

(Continued)

*Primary Examiner* — Erick Solis

(74) *Attorney, Agent, or Firm* — Kenyon & Kenyon LLP

(57) ABSTRACT

An ignition coil for an Otto engine for an high-voltage winding has a conductive, laminar component, which is at a specified distance from the high-voltage winding and which is electrically connected to a terminal of the ignition coil. In a method for the capacitive coupling of the high-voltage winding of an ignition coil for diagnostic purposes, a conductive, laminar component of the ignition coil, which is at a specified distance from the high-voltage winding and which is electrically connected to a terminal of the ignition coil, is used as a capacitive coupling element.

9 Claims, 3 Drawing Sheets

(56) References Cited

FOREIGN PATENT DOCUMENTS

| | | |
|---|---|---|
| DE | 37 05 692 | 9/1998 |
| DE | 200 20 737 | 5/2002 |
| DE | 103 42 533 | 6/2005 |
| DE | 103 57 349 | 7/2005 |
| EP | 0 412 678 | 2/1991 |
| EP | 1081375 | 3/2001 |

* cited by examiner

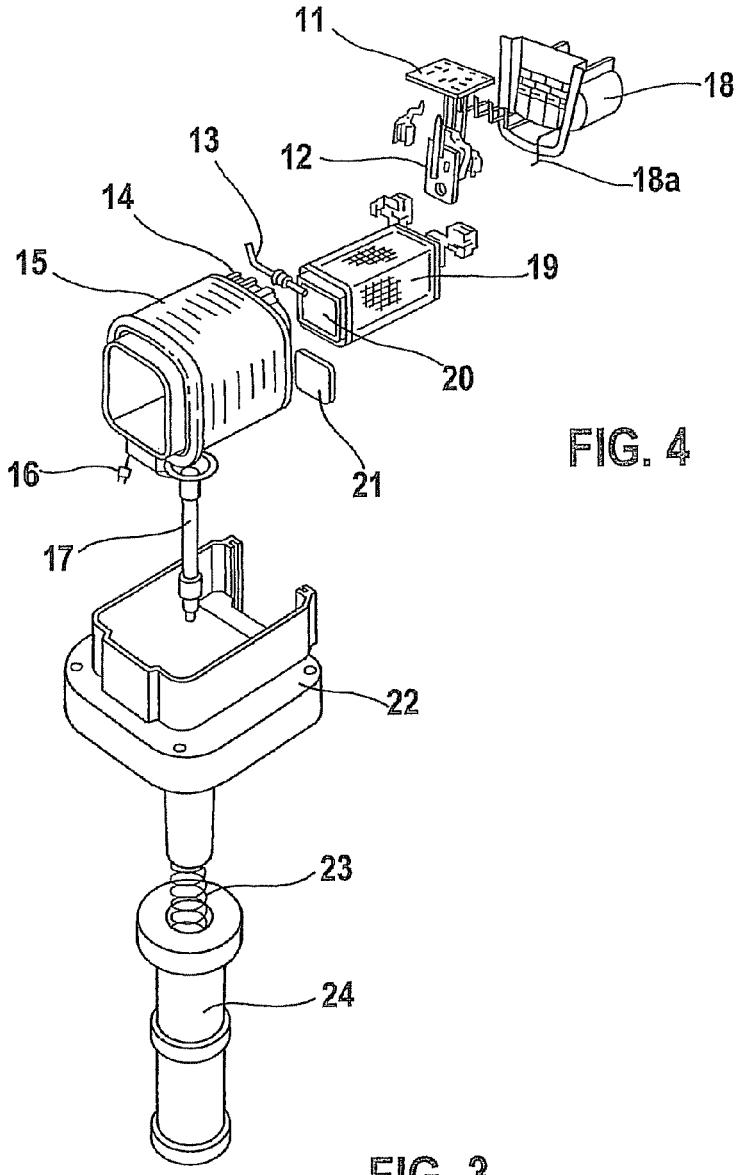
FIG. 4
FIG. 3
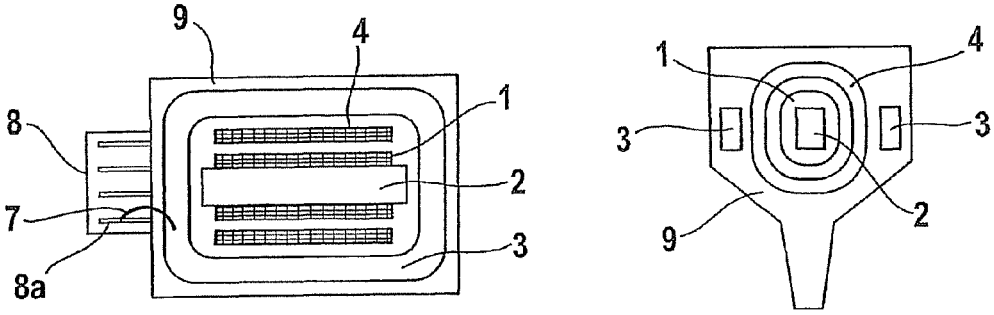

IGNITION COIL

FIELD OF THE INVENTION

The present invention relates to an ignition coil for an Otto engine, which has a high-voltage winding. Furthermore, the present invention relates to a method for capacitive coupling the high-voltage winding of an ignition coil for diagnostic purposes.

BACKGROUND INFORMATION

The ignition coil is that component of the inductive ignition system which generates the high voltage, required for the spark arc-over at the spark plug, from the low battery voltage. It is fed by the DC vehicle electrical system and supplies ignition pulses for the spark plug having the required high voltage and spark energy. This component has continued to be developed further in the course of time and has been adapted to the increased requirements on the Otto engine.

The types of ignition coil used for new developments are essentially compact ignition coils and rod-type ignition coils. In a compact ignition coil, the magnetic circuit is made up of an O core and an I core onto which the primary and secondary windings are plugged. This arrangement is built into the ignition coil housing. The primary winding, that is, the I core wound with wire, is electrically and mechanically connected to the primary plug connection. The beginning of the winding of the secondary winding is also connected, that is, the coil shell wound with wire. The connection of the secondary winding at the spark plug end is located in the housing, and the electrical contacting is produced during the mounting of the winding. Based on the compact design of the ignition coil, a construction is made possible in which the ignition coil is mounted directly on the spark plug, so that additional high-voltage connecting cables are not required. This brings about a lower capacitive load of the secondary circuit of the spark plug compared to a variant in which the mounting takes place away from the spark plug. In addition, functional safety is increased by the reduction in components, for instance, the gnawing of the ignition cable by rodents is no longer possible. The rod-type ignition coil enables the best possible utilization of space relationships in the engine compartment.

Because of the cylindrical design, the spark plug pit may also be used as a mounting space, and it makes possible a space-optimized arrangement in the cylinder head. Rod-type coils are always mounted directly on the spark plug, and therefore no additional high-voltage connecting cables are required. Rod-type ignition coils work as compact ignition coils do, according to the same inductive principle. However, because of the rotational symmetry, they are clearly different in design from compact ignition coils. The most obvious difference is in the magnetic circuit. It is made up of the same materials, the rod core that lies in the middle being made up of sheet metal lamina stamped to different widths and stacked to be approximately round and assembled to a stack. The magnetic circuit is produced via a magnetic sheet metal yoke as a rolled and slotted shell. In contrast to compact ignition coils, the primary winding, having a greater diameter, lies over the secondary winding whose coil shell accommodates the rod-type core at the same time.

Current ignition systems are predominantly free from maintenance. For diagnostic purposes, e.g. for shop maintenance, search for faults in the automobile engine, online monitoring, etc., it is expedient, however, to check orderly functioning. But, because of the direct insertion of current ignition coils into the cylinder head, an electrical diagnosis of the functioning can be carried out only with difficulty or not at all. Adapter solutions are generally eliminated, based on cramped installation positions or danger caused by high voltage. One known approach, however, represents the capacitive coupling of the high-voltage winding via a measuring probe in the form of a lamina. Together with the secondary winding, this arrangement forms a coupling capacity which makes it possible to couple out and measure a corresponding characteristic signal that corresponds to the signal curve of the generated high voltage of the ignition coil.

In the newer ignition coil designs this is partially no longer possible since, based on tightened space, the ignition coil is not accessible, or the coupling to the high-voltage winding using a measuring probe is not possible, for instance, based on a missing outer air gap of the ignition coil, or only by a design approach that requires great additional constructional effort.

It is an object of the exemplary embodiments and/or exemplary methods of the present invention to state an ignition coil which makes possible checking the functioning by capacitive coupling of the high-voltage winding, as well as a method for the capacitive coupling of the high-voltage winding of an ignition coil for diagnostic purposes.

SUMMARY OF THE INVENTION

An ignition coil according to the exemplary embodiments and/or exemplary methods of the present invention is defined by the features described herein, and the method of capacitive coupling of the high-voltage winding of an ignition coil for diagnostic purposes is defined by the features of Claim 9.

Further exemplary embodiments of the present invention are also described herein.

The basic principle of the design approach to the object is to provide a conductive, laminar component in the ignition coil, which is at a specified distance from the high-voltage winding, and which is connected electrically to a terminal of the ignition coil. With respect to a usual ignition coil, this component may be an additional component, or it may also be an appropriately designed component of a usual ignition coil, which is connected electrically, additionally, according to the exemplary embodiments and/or exemplary methods of the present invention, to a terminal of the ignition coil.

Because of the design according to the exemplary embodiments and/or exemplary methods of the present invention of an ignition coil, the principle of capacitive coupling of the secondary winding for diagnostic purposes may be maintained. However, according to the exemplary embodiments and/or exemplary methods of the present invention, a component of the ignition coil itself is used as the capacitive coupling element, which is electrically connected to a terminal of the ignition coil. Consequently, one may couple out a diagnostic signal that is able to be evaluated. On the one hand, this has the advantage that this function is fulfilled without an additional external component, and on the other hand, the diagnostic signal is able to be processed online by an additional fixed internal connection in the ignition coil and the cable connection to the control unit by suitable means, e.g. an electronic circuit or software, that is, during the running operation in the engine/vehicle, for instance, to satisfy the OBD regulations.

Thus, it turns out in particular that the recording of measurements and the diagnostic signal is able to take place, and that the diagnostic signal may be coupled out in a simple manner, a manual intervention, e.g. applying or coupling the measuring probe not being necessary. Furthermore, the specified distance of the component from the high-voltage winding and its specified flatness yield a reproducible signal over all ignition coils of one kind, and thus an inadequate signal quality in conjunction with an insufficient coupling that is manual, as a rule, no longer exists, whereby diagnostic errors are able to be avoided. Moreover, permanent online processing or 100% evaluation of the signal is possible, and the signal may be processed further at will, for instance, for engine control, a shop diagnosis, measuring systems for functional analysis, development and the release of ignition systems, etc.

The conductive, planar component may be electrically insulated from other elements of the ignition coil, except for the connection, to the terminal of the ignition coil.

The conductive, planar component may be situated within the housing of the ignition coil or on the housing of the ignition coil.

In the case where the ignition coil is developed as a compact ignition coil, the conductive, planar component may be formed by the O core of the ignition coil. In this case, only the O core present in the ignition coil needs to be connected to a terminal of the ignition coil, in order to implement an ignition coil according to the present invention.

In the case where the ignition coil according to the present invention is developed as a rod-type ignition coil, the conductive, planar component may be formed by the rod core of the ignition coil. In this case, then, only the rod core present in the ignition coil needs to be connected to a terminal of the ignition coil, in order to implement an ignition coil according to the present invention.

The conductive, planar component of the ignition coil according to the present invention may be provided electrically potential-free with respect to the vehicle electrical system of a motor vehicle into which the ignition coil has been built in, with respect to a current supply of the ignition coil and/or a ground of the motor vehicle and/or the ignition coil.

The ignition coil according to the present invention may be mounted directly on a spark plug.

In the method for the capacitive coupling of the high-voltage winding of an ignition coil for diagnostic purposes, according to the exemplary embodiments and/or exemplary methods of the present invention, a conductive, planar component of the ignition coil, which is at a specified distance from the high-voltage winding and which is electrically connected to a terminal of the ignition coil, is used as a capacitive coupling element. In this instance, the design of the conductive, planar component may be made according to the specific embodiments of the ignition coil, according to the present invention, described above.

Additional advantages of the exemplary embodiments and/or exemplary methods of the present invention are given in the following description of the drawings. An exemplary embodiment of the present invention is shown in the drawings. The drawings, the description and the claims include numerous features in combination or as an exemplary embodiment of the present invention. One skilled in the art will also expediently view the features individually, and/or will combine them to form meaningful further combinations.

BRIEF DESCRIPTION OF THE DRAWINGS

FIG. 3 shows the construction of a compact ignition coil in the first exemplary embodiment according to the present invention, in two sectional representations.

FIG. 4 shows the construction of the compact ignition coil in the first exemplary embodiment according to the present invention, in an exploded representation.

DETAILED DESCRIPTION

Figure 1:
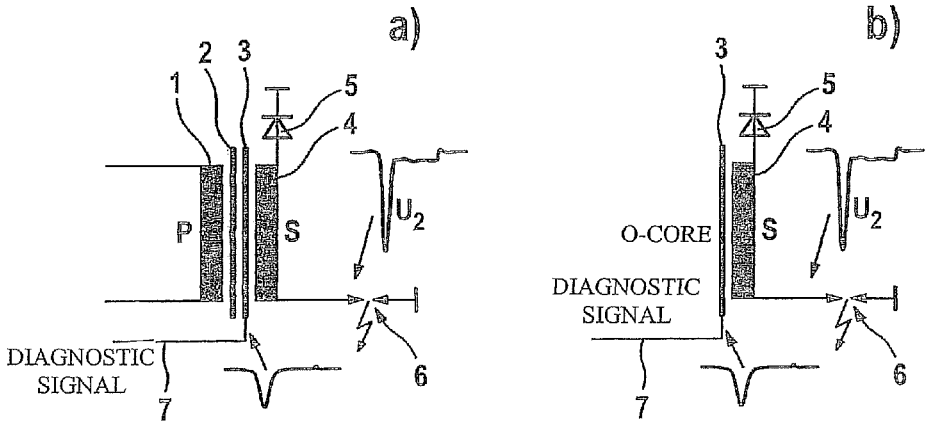
FIG. 1 shows an illustration in principle of the circuit of an ignition coil according to the present invention, and an exemplary form of the coupling in a first exemplary embodiment.

FIG. 1 shows a schematic representation of an ignition coil according to a first exemplary embodiment of the present invention. A primary, or low-voltage winding 1, that is connected via an ignition output stage, that is not shown, to a battery that is also not shown, is coupled via a magnetic core, which is composed in this case of an I core 2 and an O core 3, to a secondary, or high-voltage winding 4, whose one end is connected to ground via an EFU diode 5, and whose other end is connected to ground via a spark plug 6. A signal line 7 is connected at O core 3, for picking off a diagnostic signal. Thus, except for the coupling out of the diagnostic signal via signal line 7, that is, except for signal line 7, what is involved here is the construction of a usual ignition coil. FIG. 1*b*) shows the coupling out of the diagnostic signal and the relevant components for it of the ignition coil, once more by themselves.

During the generation of the high-voltage pulse in the ignition coil, this voltage is built up over entire secondary winding 4 (also known as high-voltage winding), starting at the beginning of the winding, up to the highest voltage level at the end of the winding, that is, the spark plug terminal. The secondary winding surface essentially represents this voltage curve over the length of the winding. O core 3, having a specified distance from the secondary winding surface and specified stack height, together with secondary winding 4 and the intermediately situated insulating material (e.g. thermoplasts, encapsulating material, etc.) forms a capacitance that forms a coupling capacitor. The measuring signal coupled out, i.e. the diagnostic signal, follows approximately the average signal curve on the secondary winding surface, based on the O core area running over the entire winding surface. The diagnostic signal is of the same phase, but damped and having a clearly lower voltage level.

The lamellar stack of O core 3 is made of electrical sheet metal and conducts electricity well. The electrical contacting of O core 3 may be made as desired, using a wire, a terminal pin, a conductor rail, etc., that is, any desired signal line 7, to the outside (e.g. separate cable terminal) or to the terminal plug of the ignition coil. Consequently, it is possible directly to record the capacitive signal that is coupled out.

Figure 2:
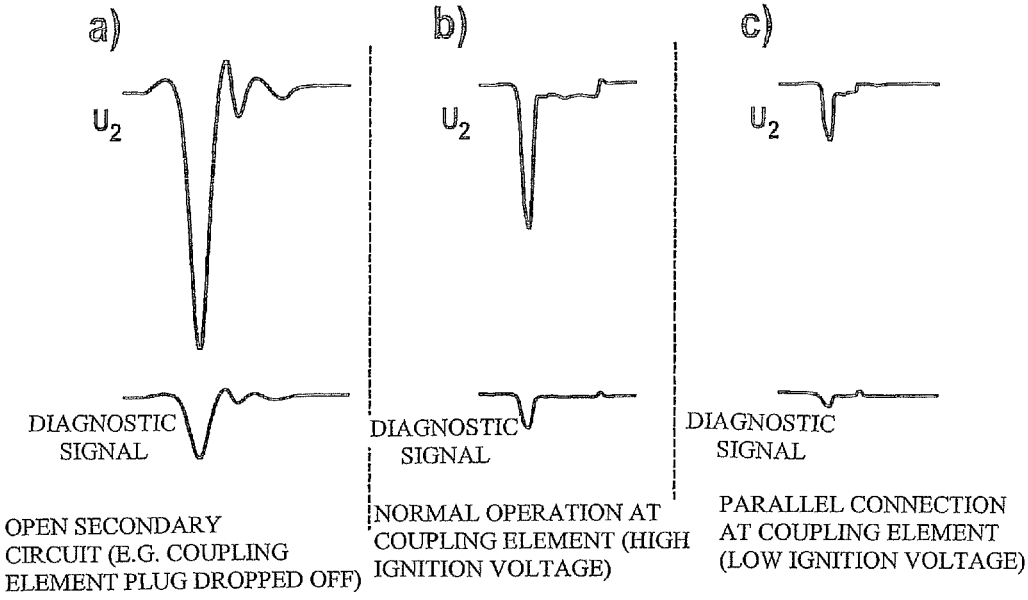
FIG. 2 shows an assignment of output signals of an ignition coil according to the present invention having associated diagnostic signals in various operating states.

FIG. 2 shows three different output signals of both ignition voltage $U_2$ and the diagnostic signal. FIG. 2*a*) shows ignition voltage $U_2$ and the diagnostic signal for an open secondary circuit, that is, for the case where there exists no connection to the spark plug, that, for instance, the spark plug connector has dropped off. In this case, ignition voltage $U_2$ involves a negative voltage pulse having great amplitude, which dies away strongly damped. At reduced voltage level, the diagnostic signal behaves correspondingly. FIG. 2*b*) shows a normal operation at a spark plug where a high ignition voltage exists. In this case one may recognize a clearly reduced level of the negative voltage pulse, as compared to FIG. 2*a*), which first falls off to a lower level before it dies away. The diagnostic signal is reduced in level correspondingly. FIG. 2*c*) shows the signal curve of ignition voltage $U_2$ and the diagnostic signal in response to a parallel connection at the spark plug, there being present a lower ignition voltage and a correspondingly reduced diagnostic signal. The signal curves are comparable, except for the even lower amplitudes, to those of the normal operation shown in FIG. 2*b*).

FIG. 3 shows a schematic representation of the design in principle of a compact ignition coil according to the first exemplary embodiments according to the present invention shown in FIG. 1, in two sectional views. O core 3 lying within housing 9 forms a capacitor together with secondary winding 4. The capacitance is formed via the inner area of O core 3, which faces secondary winding 4. Signal line 7, which forms a conductive connection of O core 3 to a terminal contact 8*a* of terminal 8 of the ignition coil, which may also be designed as a separate connection, makes possible coupling out the capacitive coupled signal of secondary winding 4. At terminal 8, besides terminal contact 8*a* for coupling out the diagnostic signal, other terminal contacts are provided for connecting primary winding 1 that is wound around I core 2, as well as connecting the ignition coil to ground and the spark plug terminal.

In order for the O core to be able to form a capacitor with the secondary winding, the capacitor is designed to be potential-free with respect to the vehicle electrical system and the current supply or ground. This is possible for insulated cores (e.g. for reasons of corrosion protection, electrical insulation from being touched), cores extruded in a thermoplastic housing or cores inserted into a housing and encapsulated.

FIG. 4 shows an exploded representation of an ignition coil according to the present invention in an additional embodiment of the first exemplary embodiment. The ignition coil shown is constructed in the usual way, but it includes an additional primary plug contact 18*a*, which, in the assembled state, is connected to O core 22 that is developed to be insulated, according to the exemplary embodiments and/or exemplary methods of the present invention. Going into details, the compact ignition coil shown includes the following components: a printed-circuit board 11, an output stage 12, an EPU diode 13, a secondary coil element 14, a secondary wire 15, a sheet metal contact 16, a high-voltage bolt 17, a primary plug 18 having primary plug contact 18*a* for coupling out the diagnostic signal, a primary wire 19, an I core 20, a permanent magnet 21, O core 22, a spring 23 and a silicone jacket 24.

Figure 5:
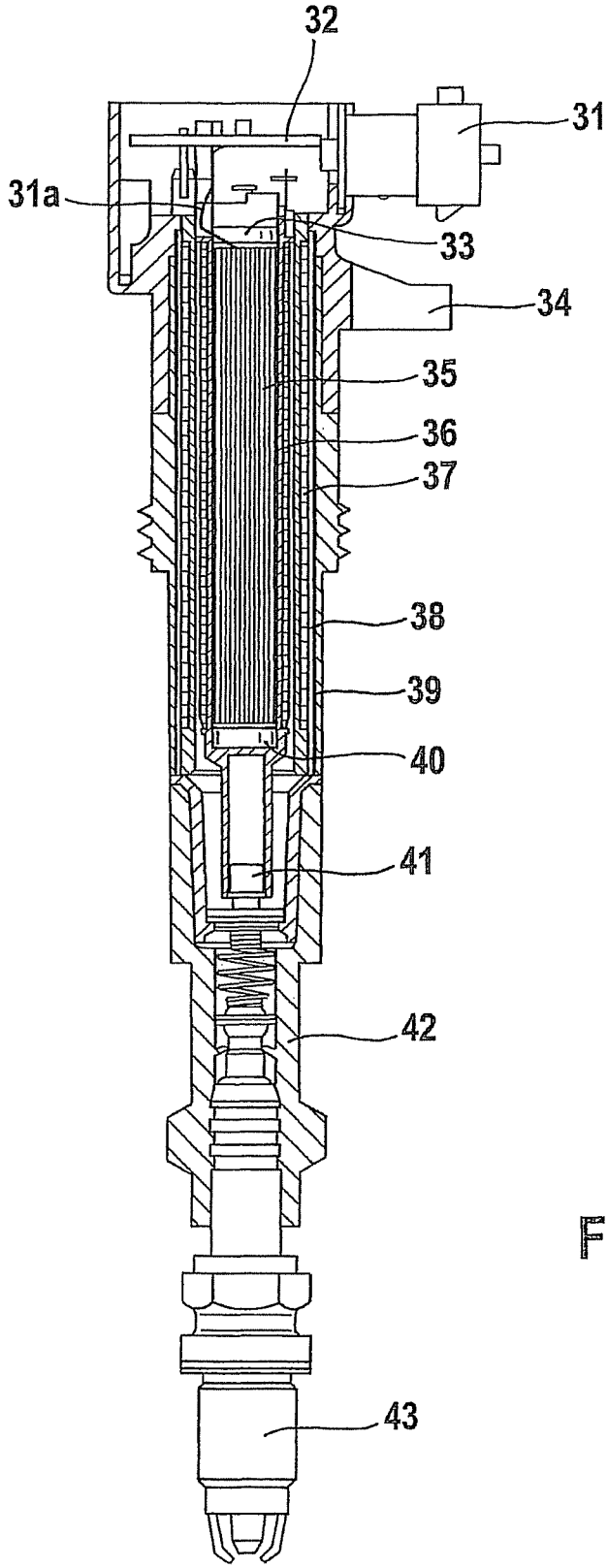
FIG. 5 shows the construction of a rod-type ignition coil according to a second exemplary embodiment, according to the present invention, in section.

FIG. 5 shows the construction of an ignition coil according to the present invention, as in a second exemplary embodiment according to the present invention, in section, namely a rod-type ignition coil. This is constructed the same as a usual rod-type ignition coil, except for an additional connecting wire 31*a*, which connects rod core 35 to plug terminal 31. In detail, the rod-type ignition coil, according to the exemplary embodiments and/or exemplary methods of the present invention, includes the following components: plug terminal 31 having connecting cable 31*a*, a printed-circuit board 32 having an ignition output stage, a permanent magnet 33, a fastening arm 34, lamellar electric sheet metal core 35, that is, the rod core, a secondary winding 36, a primary winding 37, a housing 38, a magnetic sheet metal yoke 39, a permanent magnet 40, a high-voltage pin 41 and a silicone jacket 42. Also shown in FIG. 5 is a spark plug 43 that is plugged in.

What is claimed is:

1. An ignition coil for an Otto engine, comprising:

a low-voltage winding;

a conductive, laminar component contained within a housing of the ignition coil; and a high-voltage winding positioned at a predetermined distance from and concentric to the low-voltage winding;

wherein the conductive, laminar component is concentric to the high-voltage winding, is adjacent to and at a specified distance from the high-voltage winding, and is a core that forms a capacitor with the high-voltage winding, with the capacitor including an insulating material disposed between the conductive, laminar component and the high-voltage winding, and wherein the conductive, laminar component is electrically connected to a terminal of the ignition coil.

2. The ignition coil of claim 1, wherein the conductive, laminar component is electrically insulated from other elements of the ignition coil except for the connection to the terminal of the ignition coil.

3. The ignition coil of claim 1, wherein the conductive, laminar component is situated on a housing of the ignition coil.

4. The ignition coil of claim 1, wherein the conductive, laminar component is situated on a housing of the ignition coil.

5. The ignition coil of claim 1, wherein the ignition coil is a compact ignition coil and the conductive, laminar component is formed by the O core of the ignition coil.

6. The ignition coil of claim 1, wherein the ignition coil is a rod-type ignition coil and the conductive, laminar component is formed by the rod core of the ignition coil.

7. The ignition coil of claim 1, wherein the conductive, laminar component is electrically potential-free with respect to the vehicle electrical system of a motor vehicle, into which the ignition coil is installed, with respect to at least one of a current supply of the ignition coil, and a ground of the motor vehicle and the ignition coil.

8. The ignition coil of claim 1, wherein the ignition coil is mounted directly on a spark plug.

9. A method for capacitively coupling a high-voltage winding of an ignition coil for diagnostic purposes, the method comprising:

positioning the high-voltage winding at a predetermined distance from and concentric to a low-voltage winding of the ignition coil;

positioning a conductive, laminar component of the ignition coil concentric to the high-voltage winding, adjacent to and at a specified distance from the high-voltage winding, and within a housing of the ignition coil, the conductive, laminar component being a core that forms a capacitor with the high-voltage winding, with the capacitor including an insulating material disposed between the conductive, laminar component and the high-voltage winding; and electrically connecting the conductive, laminar component of the ignition coil to a terminal of the ignition coil, so as to provide a capacitive coupling.

* * * * *

UNITED STATES PATENT AND TRADEMARK OFFICE

CERTIFICATE OF CORRECTION

PATENT NO. : 8,590,518 B2
APPLICATION NO. : 12/302982
DATED : November 26, 2013
INVENTOR(S) : Klaus Lerchenmueller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1395 days.

Signed and Sealed this
Twenty-second Day of September, 2015

Michelle K. Lee

Michelle K. Lee
*Director of the United States Patent and Trademark Office*